United States Patent [19]

Little et al.

[11] 4,168,877

[45] Sep. 25, 1979

[54] SINGLE LEVER BACK PLANE CONNECTOR SYSTEM

[75] Inventors: David M. Little; Timothy L. Kocher, both of Harrisburg, Pa.

[73] Assignee: AMP Incorporated, Harrisburg, Pa.

[21] Appl. No.: 919,592

[22] Filed: Jun. 27, 1978

[51] Int. Cl.[2] ..... H01R 13/54; H01R 13/58

[52] U.S. Cl. ..... 339/103 M; 339/91 R; 361/413

[58] Field of Search ..... 361/413; 339/75 M, 184 M, 339/186 M, 91 R, 17 LC, 103 M, 107

[56] References Cited

U.S. PATENT DOCUMENTS

| | | | |
|---|---|---|---|
| 3,329,925 | 7/1967 | Johnson et al. | 339/91 R |
| 3,594,696 | 7/1971 | Witek | 339/91 R X |
| 3,848,222 | 11/1974 | Lightner | 339/75 M |
| 3,899,234 | 8/1975 | Yeager et al. | 339/74 R |
| 4,037,906 | 7/1977 | Jayne | 339/107 |
| 4,070,081 | 1/1978 | Takahashi | 339/91 R |
| 4,127,316 | 11/1978 | McKee et al. | 339/91 R X |

FOREIGN PATENT DOCUMENTS

| | | | |
|---|---|---|---|
| 2326543 | 12/1974 | Fed. Rep. of Germany | 339/91 R |

*Primary Examiner*—E. F. Desmond
*Attorney, Agent, or Firm*—Russell J. Egan

[57] ABSTRACT

An electrical connector system is disclosed having a pin header and housing assembly which can be latched and separated by the action of a single lever. The subject system includes a pin header mountable on a printed circuit board or the like to enclose an array of pin terminals fixedly mounted therein. The pin header also includes a standoff feature allowing wire wrap connection to the terminals. A connector member is receivable in the pin header and, by means of a lever actuated cam, is locked therein and extracted therefrom. The connector member also includes strain relief means for conductors connected to receptacle terminals carried thereby and the ability to individually probe the terminals without dismounting the connector member from the pin header.

15 Claims, 5 Drawing Figures

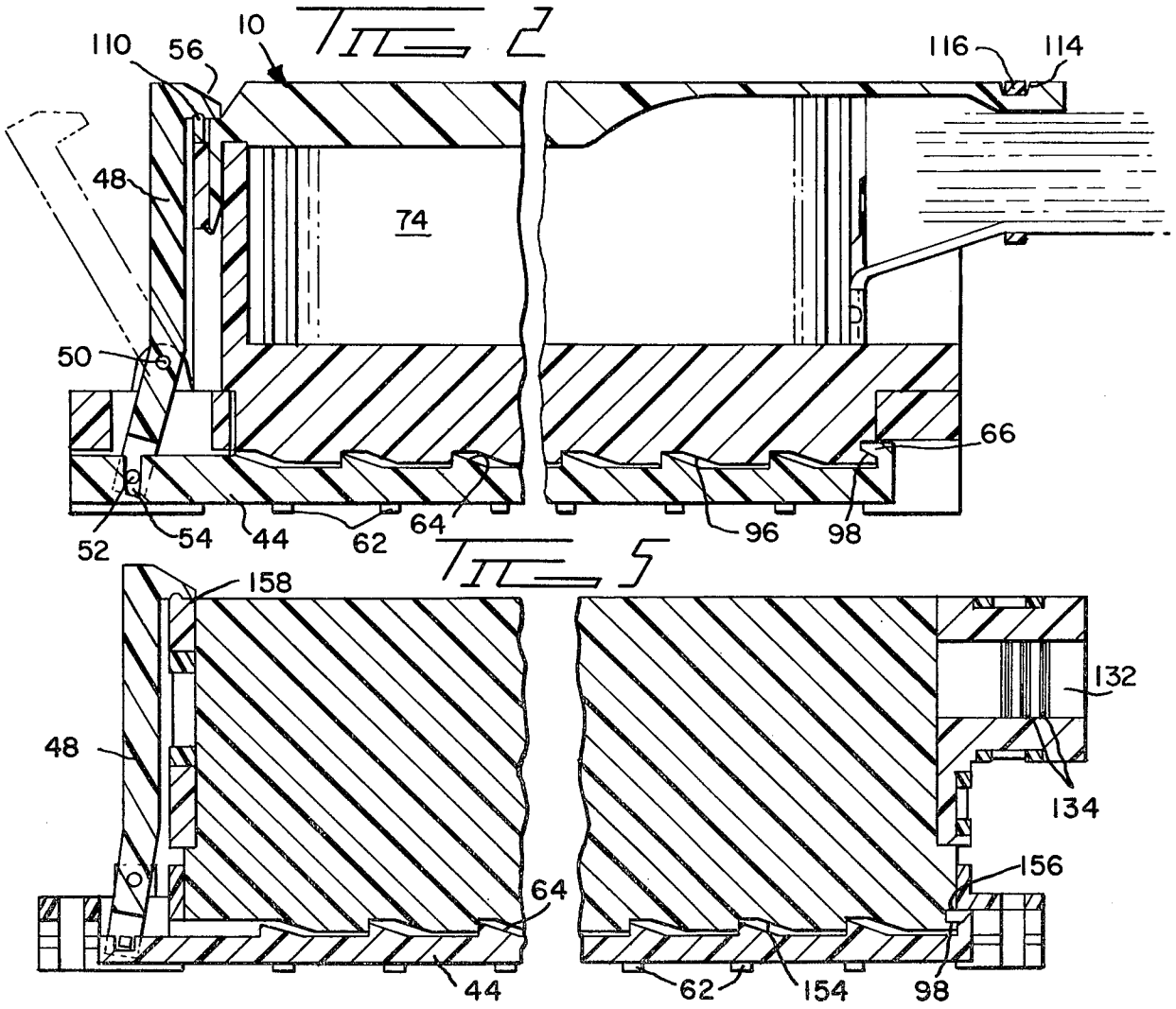
114
116
66
98
96
74
64
62
44
54
52
50
48
10
56
110
132
134
156
154
158
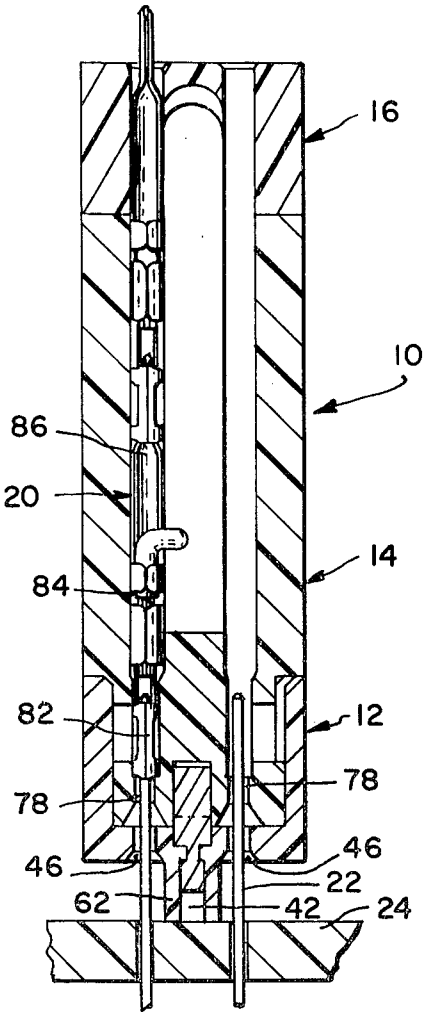
16
10
14
12
78
46
22
24
42
62
86
20
84
82

SINGLE LEVER BACK PLANE CONNECTOR SYSTEM

BACKGROUND OF THE INVENTION

1. The Field of the Invention

The present invention relates to a back plane connector system and in particular to a connector system having a pin header forming a shroud around an array of fixed pin terminals and engageable by a connector member which is latched to and separated from the pin header by a cam actuated lever, the connector member providing for electrical probing of individual terminals carried therein when mated.

2. The Prior Art

There are many instances in the electrical industry when it is desired to have the ability to probe mated electrical connectors in order to ascertain proper electrical conditions and/or to trouble shoot unwanted existing conditions. Heretofore the conventional electrical connectors have been of a closed nature which are of such configuration as to make probing individual terminals extremely difficult if not impossible.

It is also highly desirable in the electrical connector industry to have connector assemblies arranged to provide shrouded protection for pin arrays and positive mating with the arrays by an electrical connector which can be latched in position and yet readily extracted therefrom. It is also desirable that any electrical connector system provide for strain relief of the conductors leading to the terminals carried thereby.

SUMMARY OF THE PRESENT INVENTION

The present invention concerns a single level back plane connector system having a pin header and mating connector member. The pin header provides a standoff shroud about an array of fixed pin terminals. The pin header has a latching lever, camming means actuated by the lever, and means to mount the pin header on a surface having the array of pin terminals fixedly mounted therein. The mating connector member is profiled for engaging in the pin header and to be acted upon by the camming means to be lockingly engaged in the header. The connector member also has strain relief means for conductors attached to receptacle terminals carried by the connector and means providing for probing of individual terminals carried thereby without dismounting of the connector from the pin header.

It is therefore an object of the present invention to produce an improved single lever back plane connector system having a cam actuated latching means.

It is another object of the present invention to produce a single lever back plane connector system in which the terminals of the system can be individually probed while in a mated condition.

It is another object of the present invention to produce a single lever back plane connector system having a pin header providing standoff shroud protection of an array of fixed terminals as well as access to the terminals for wire wrap connection.

It is a further object of the present invention to produce a single lever back plane connector system in which all conductors leading to the connector member are provided with strain relief means.

It is yet another object of the present invention to produce a single lever back plane connector system which can be readily and economically produced.

The means for accomplishing the foregoing objects and other advantages of the present invention will become clear to those skilled in the art from the following detailed description taken with reference to the accompanying drawings.

BRIEF DESCRIPTION OF THE DRAWINGS

FIG. 2 is a transverse vertical section through the assembled connector of FIG. 1;

FIG. 3 is a longitudinal vertical section through the subject connector of FIGS. 1 and 2;

FIG. 5 is a longitudinal vertical section, similar to FIG. 3, taken through the alternate embodiment of FIG. 4.

DETAILED DESCRIPTION OF THE EMBODIMENTS

Figure 1:
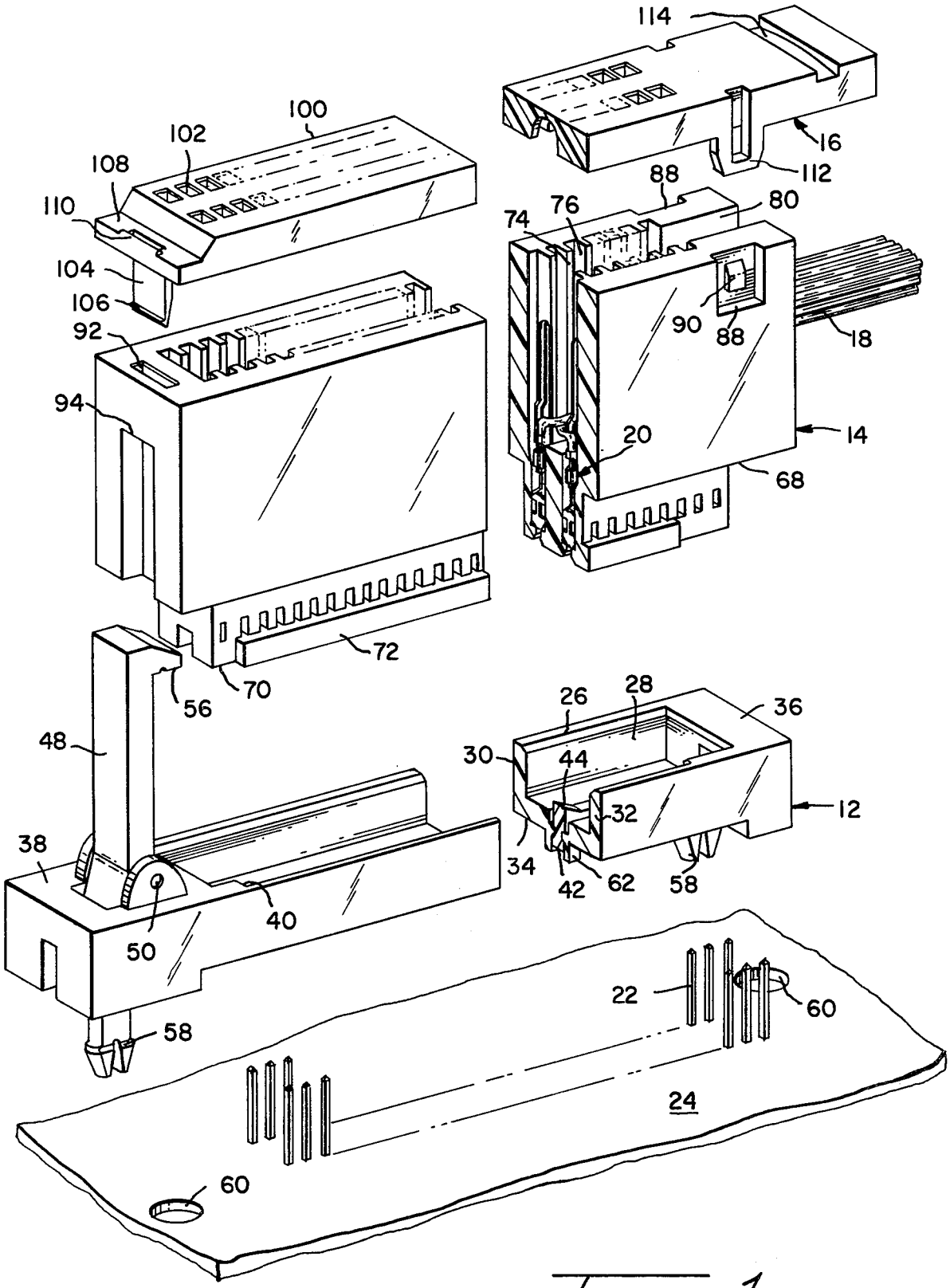
FIG. 1 is an exploded perspective view of the subject back plane connector system.

The preferred embodiment of the subject connector system 10 is shown in FIGS. 1 to 3 and included a pin header member 12, a mating connector member 14, having a cover member 16, for connecting a plurality of conductors 18, each terminated by a receptacle terminal 20 to a like plurality of pin terminals 22 mounted in a fixed array on panel 24, which can be a printed circuit board or the like.

The pin header member 12 comprises an elongated housing 26 having an elongated cavity 28 defined by spaced sidewalls 30, 32 interconnected by profiled base 34 and end walls 36, 38. At least one of the sidewalls is provided with a polarizing profile 40. The profiled base 34 has a centrally located, longitudinally extending slot 42 in which an elongated cam member 44 is mounted. A plurality of apertures 46 are formed in the base spaced apart and configured to receive the pin terminals 22 therein. A latching lever 48 is mounted in end portion 38 by pivot pin 50 with pin 52 on the lower end of the lever engaging in slot 54 in cam 44. The upper end of the lever 48 is profiled with a latching lug 56. The pin header member 12 also includes mounting feet 58, which engage in apertures 60 in panel 24, and standoff spacers 62, which also serve to support the cam 44. The cam 44 further includes an upwardly directed cam surface 64 and an inwardly directed latching lug 66 on the free end thereof. Both pins 50 and 52 can be formed as integral portions of lever 48.

The connector member 14 includes a housing 68 having a mating face 70 receivable in the cavity 28 of the pin header member 12. This face 70 can include a polarizing projection 72 receivable with like polarizing or keying recesses 40 in the sidewall 32. The housing also has an elongated central cavity 74 having a plurality of terminal receiving channels 76 on the opposite elongated sides thereof with each channel communicating with the mating face 70 by a like aperture 78. One end 80 of the cavity 74 is open in an upward direction to provide access to the cavity for the conductors 18. A terminal 20 is mounted in each channel 76 and includes three portions, namely, a terminal pin engaging receptacle portion 82 at one end, a conductor engaging intermediate portion 84, and a probe engaging tail portion 86. The housing 68 further has, at one end thereof, a pair of recesses 88 each having a latching lug 90 projecting outwardly therefrom and, at the opposite end, a passage 92 defining a shoulder 94. The mating face 70 includes camming surfaces 96 and latching recess 98 both of which are engageable by the cam 44 and best seen in FIG. 3.

The cover 16 is an elongated member 100 having a plurality of apertures 102 therein, each aligned with a respective channel 76 of the connector 14. One end of the cover has a forward latching leg 104 with a lip 106 on the free end engageable, through passage 92, with the shoulder 94. This end of the cover also has a latching shoulder 108 with a lip 110 on the edge thereof. The cover has a pair of U-shaped latching members 112 at the opposite end, each engageable with a respective lug 90. The cover 16 also has a transverse recess 114 adjacent the rear end thereof which is used to secure the conductors 18 to the member by means of a bundle tie 116 of known configuration.

The subject system is assembled by first mounting the pin header member 12 on the panel 24 in a conventional manner. The mounting or retaining legs 58 are inserted and latched in the respective apertures 60 with the individual pin terminals 22 passing through the respective apertures 46. A lower portion of each terminal is exposed for making wire wrap connection and the wires thus terminated can be passed to either side between the spacers 62. The terminals 20 are next terminated to the respective conductors 18, in known fashion by crimping the intermediate portion of the terminal, and are inserted into the channels 76 of the connector 14 with the conductors 18 being fed out the open end 80. It would be obvious to those skilled in the art that the simplest manner for the effecting this mounting would be to commence at the right hand portion, as shown in FIG. 1, and work towards the left so that the conductors of the terminals furtherest from the open end 80 would be on the top of the bundle of conductors. The housing cover 16 is then snapped in place and a bundle tie 116 applied to secure the conductors in the housing. The connector member 14 is then mated in the pin header 12 by a simple direct motion and locked therein by a rotational movement of the lever 48. This motion causes the cam 44 to be moved to the left, as shown in FIG. 3, so that the connector is latched by the lug 66 engaging in recess 98 and the lug 56 engaging shoulder 108 and lip 110. The connector is thus securely held in position by the latching of opposite corners.

An unlatching rotational movement of lever 48 will not only free lugs 56 and 66 but cause cam surface 64 to engage the cam surface 96 of connector 14 to drive the connector up off the pin terminals 22.

The connector is also arranged so that the individual contacts 22 can be suitably probed. FIG. 3 shows what in fact is two contacts 20 stacked one on top of the other, although only one terminal is used for terminating a conductor 18. This arrangement would be used in an instance when it was desired to have the tail portion 86 of a contact 20 actually extend beyond the surface of the cover 16.

Figure 4:
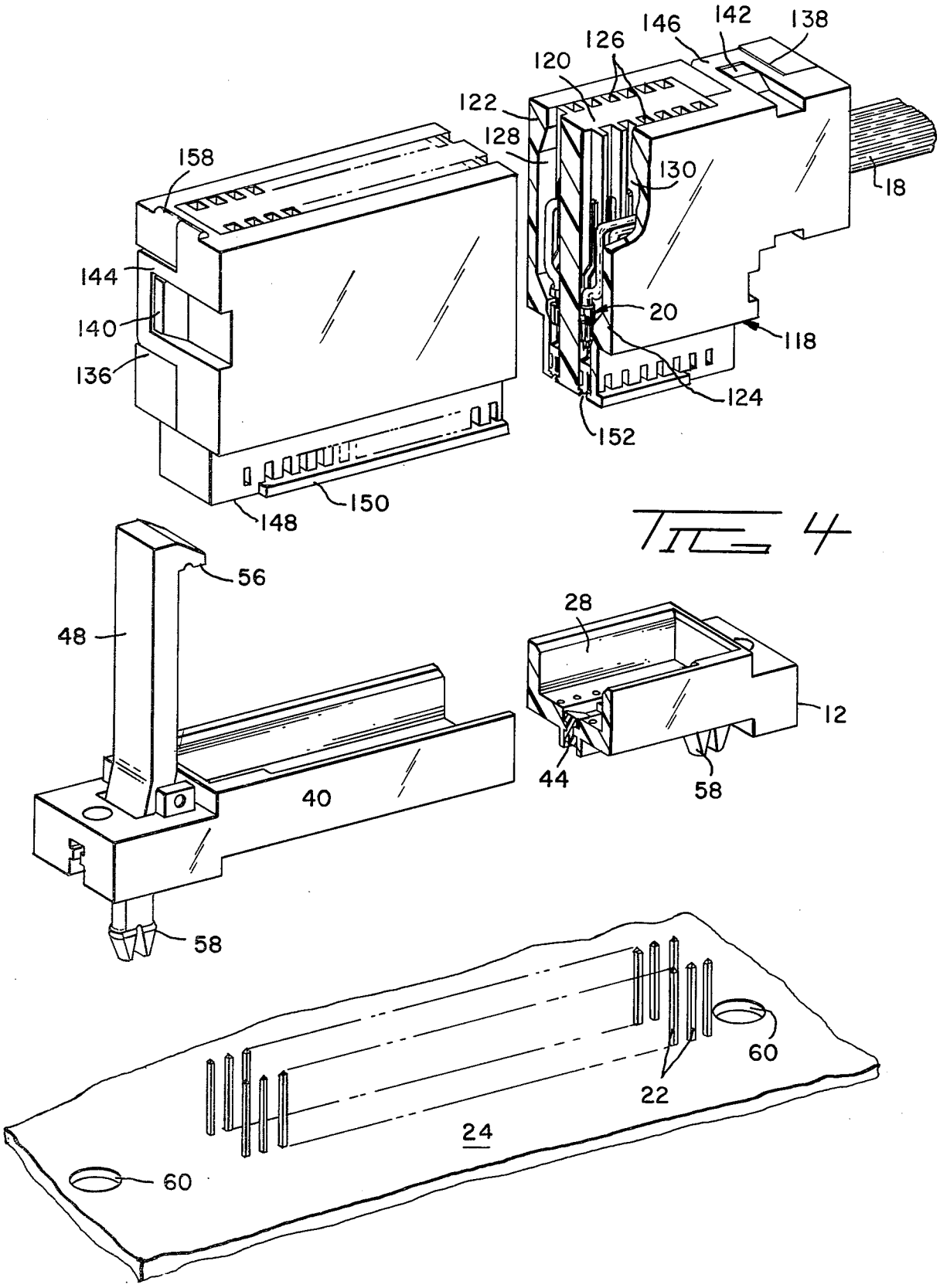
FIG. 4 is an exploded perspective view of an alternate embodiment of the subject invention.

An alternate embodiment of the subject connector system is shown in FIGS. 4 and 5 and differs from the primary embodiment only in the connector portion. In this embodiment the connector 118 has a central portion 120 with a pair of integral members 122, 124 which are hingedly connected thereto. The central portion 120 has a plurality of outwardly directed terminal receiving channels 126 on both sides thereof. The sidewall members have an inner profile to define conductor passages 128, 130 on opposite sides of the central portion 120. A rear passage 132 communicates with both passages 128, 130 and has a plurality of inwardly directed ridges 134 which engage the conductors 18 in the closed condition forming a strain relief therefor. One sidewall is provided with latching recesses 136, 138, each having a latching lug 140, 142 therein. The opposite sidewall includes integral U-shaped latching members 144, 146. The connector also has a mating face 148 provided with polarizing means 150, pin terminal passages 152, a camming profile 154, latching recess 156, and latching shoulder 158.

The function and operation of this embodiment is substantially the same as with the previous embodiment with the exception of that there is one less piece involved and the sidewalls are opened to receive the terminals 20.

The terminated terminals 20 would be loaded into the connector starting from the right (FIG. 4) and, when all terminals are loaded, the conductors 18 dressed to lie within cavities 128, 130. The sidewall members 122, 124 would then be closed and latched by engagement of members 146, 148 with lugs 140, 142, respectively.

The present invention may be subject to many modifications and changes without departing from the spirit or essential characteristics thereof. The present embodiment should therefore be considered in all respects as being illustrative and not restrictive of the scope of the invention.

What is claimed is:

1. An electrical connector system comprising:

a pin header member defining an elongated cavity, a plurality of terminal pins in a fixed array in said cavity;

latching means movably mounted on said header member;

a connector member having a housing with a mating face profiled to be received in said elongated cavity;

a longitudinal cavity extending substantially the length of and opening at one end of said housing;

a plurality of contact channels extending transversely through said housing and opening both on said mating face and said longitudinal cavity;

a plurality of terminals each received in a respective contact channel and having a first mating portion at one end directed toward said mating face, an intermediate conductor engaging portion and a probe tail at the opposite end; and strain relief means engageable between conductors, attached to said terminals and said housing.

2. An electrical connector system according to claim 1 further comprising:

means to mount said pin header member on a surface to provide a stand-off shroud about said fixed array of pin terminals.

3. An electrical connector system according to claim 1 wherein said latching means comprises:

a cam member longitudinally movably mounted in a base of said elongated cavity of said pin header;

lever means operatively connected to a first end of said cam member to impart longitudinal movement thereto, first latching means on a free end of said lever means, and second latching means on a second end of said cam member.

4. An electrical connector system according to claim 1 further comprising:

a cover member mountable on said housing member to enclose said elongated cavity, said cover member having a plurality of apertures therein each aligned with a respective contact channel.

5. An electrical connector system according to claim 4 wherein said strain relief means comprises:

an extension of said cover member overhanging an end of said housing and a groove in said extension, a bundle tie engaging in said groove and securing said conductors thereto.

6. An electrical connector system according to claim 1 wherein:

said longitudinal cavity is centrally located of said connector housing and said contact channels are formed in opposing elongated sidewalls and opening into said cavity.

7. An electrical connector system according to claim 1 wherein said connector housing further comprises:

a central member; and at least one sidewall hingedly attached to said central member, said contact channels being formed in parallel spaced relation along at least one elongated face of said central member, said sidewall having a longitudinally extending recess which in a closed condition defines said longitudinal cavity between said sidewall and said central member.

8. An electrical connector system according to claim 7 wherein said strain relief means comprises:

interengaging conductor gripping means between said sidewalls.

9. An electrical connector system according to claim 1 wherein said first mating portion of said terminal comprises:

a female socket.

10. An electrical connector system according to claim 1 wherein said conductor engaging portion of said terminals comprises:

tines adapted to crimpingly engage a respective conductor.

11. An electrical connector system according to claim 1 further comprising:

a pair of terminals in each said contact channel, a probe portion of one terminal engaging in said mating portion of the other terminal to provide sufficient length so that said probe portion of said other terminal projects from said connector housing.

12. A back plane header system for mating a male connector member with a fixed array of pin terminals, said system comprising:

a pin header member having an elongated cavity and adapted to provide stand-off shroud protection about said pin array;

means on said pin header to latchingly engage said male connector member;

said male connector member having a housing with an external profile defining a mating face receivable in said pin header cavity;

a longitudinal cavity extending substantially the length of said housing and opening at one end thereof;

a plurality of contact channels passing transversely through said housing opening on said mating face and said longitudinal cavity;

a plurality of terminals each received in a respective contact channel and having a first mating portion at one end opening on said mating face, an intermediate conductor engaging portion and a probe tail at the opposite end extending substantially the length of said contact channel; and strain relief means on said housing engageable with conductors attached to said intermediate portion of said terminals.

13. The assembly according to claim 12 further comprising means to mount said pin header member on a surface enclosing said pin array.

14. A connector according to claim 12 further comprising a cover on said connector enclosing said longitudinal cavity, said cover having a plurality of apertures therein each aligned with a respective contact channel whereby individual terminals can be engaged by a test probe.

15. A connector assembly according to claim 12 wherein said strain relief means comprises a bundle tie engageable with said conductors and a portion of said connector housing.

* * * * *